United States Patent [19]

Zwahlen et al.

[11] Patent Number: 4,466,543

[45] Date of Patent: Aug. 21, 1984

[54] METHOD AND DEVICE FOR DISTINGUISHING BETWEEN FIELD CROPS, PARTICULARLY POTATOES ON ONE HAND AND STONES OR CLODS OF SOIL ON THE OTHER HAND

[75] Inventors: Hermann Zwahlen, Suberg; Ulrich Remund, Zollikofen, both of Switzerland

[73] Assignee: Bystronic Maschinen AG, Butzberg, Switzerland

[21] Appl. No.: 301,120

[22] Filed: Sep. 11, 1981

[30] Foreign Application Priority Data

Oct. 2, 1980 [CH] Switzerland ..... 7354/80

[51] Int. Cl.[3] ..... B07C 5/34

[52] U.S. Cl. ..... 209/556; 209/570; 209/599

[58] Field of Search ..... 209/552, 555, 556, 558, 209/567, 570, 571, 576, 599, 600, 656, 657; 73/12, 432 R; 324/59

[56] References Cited

U.S. PATENT DOCUMENTS

| | | | |
|---|---|---|---|
| 2,045,769 | 6/1936 | Geffcken et al. . | |
| 3,127,016 | 3/1964 | Baigent | 209/599 X |
| 3,268,073 | 8/1966 | Lehde et al. | 209/567 |
| 3,429,437 | 2/1969 | Terschanski et al. | 209/576 |
| 3,559,805 | 2/1971 | Cragg | 209/599 X |
| 3,701,419 | 10/1972 | Hutter et al. | 209/570 X |
| 3,788,466 | 1/1974 | Wilson et al. . | |
| 4,212,398 | 7/1980 | Parker et al. . | |
| 4,311,241 | 1/1982 | Lacy, Jr. et al. | 209/570 |

FOREIGN PATENT DOCUMENTS

| | | | |
|---|---|---|---|
| 530366 | 7/1931 | Fed. Rep. of Germany . | |
| 1241181 | 5/1967 | Fed. Rep. of Germany . | |
| 2506212 | 9/1977 | Fed. Rep. of Germany . | |
| 2343523 | 10/1977 | France . | |
| 2353217 | 12/1977 | France . | |
| 2394331 | 2/1979 | France | 209/599 |
| 167695 | 4/1965 | U.S.S.R. . | |
| 160399 | 2/1967 | U.S.S.R. . | |
| 448887 | 4/1975 | U.S.S.R. | 209/552 |

OTHER PUBLICATIONS

Technical Paper "Potato Harvesting and Transport", by D. C. McRae.

*Primary Examiner*—Robert B. Reeves
*Assistant Examiner*—Edward M. Wacyra
*Attorney, Agent, or Firm*—Wender Murase & White

[57] ABSTRACT

A method and apparatus for distinguishing and separating both stones and soil clods from field crops, in which a sensor (5) is simultaneously responsive to both impact and influence on a sensor-generated magnetic field and generates output signals characteristic of field crops, stones and clods. The output signals are fed to electronic circuitry (12) that distinguishes output signals produced by mechanical impact of stones and those produced by passage of clods through the magnetic field from signals generated by crops. An ejector cylinder (15) and ejector (16) separates stones and clods from crops upon receipt of a signal from the electronic circuitry.

7 Claims, 6 Drawing Figures

FIG. 2
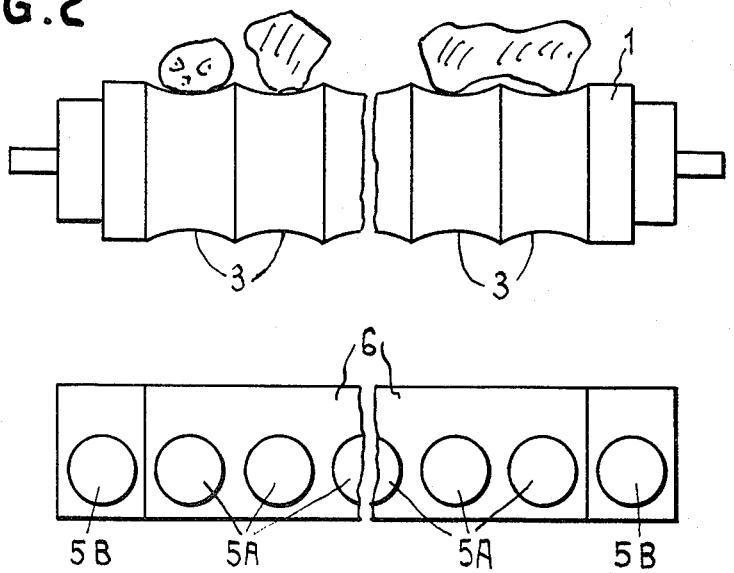
FIG. 3
FIG. 4
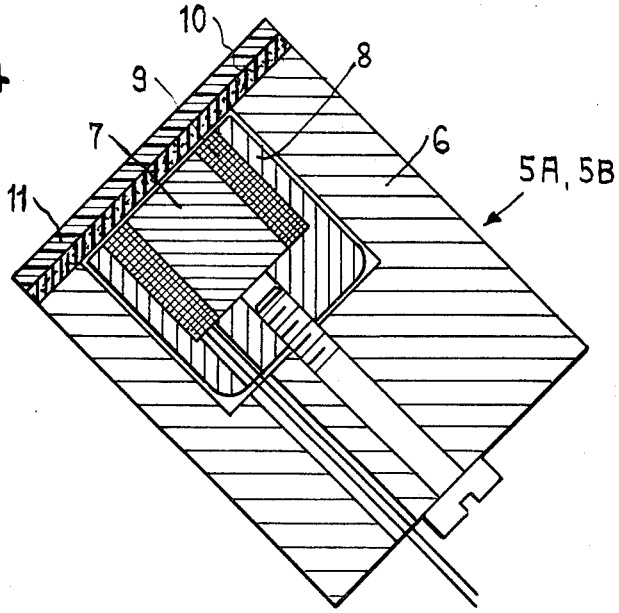

METHOD AND DEVICE FOR DISTINGUISHING BETWEEN FIELD CROPS, PARTICULARLY POTATOES ON ONE HAND AND STONES OR CLODS OF SOIL ON THE OTHER HAND

BACKGROUND OF THE INVENTION

This invention relates to a method for distinguishing between field crops, particularly potatoes on one hand and stones or clods of soil on the other hand, whereby each of these pieces to be distinguished is allowed to drop onto a sensor and whereby distinguishing criteria of the impact of said pieces onto said sensor are detected. One prior method of this kind is based exclusively onto detection of distinguishing criteria of the mechanical impact (DE-OS No. 25 06 212). However, it was found that in this manner potatoes and clods of soil may only be distinguished from each other under particularly favorable circumstances regarding humidity and kind of the soil. Such a method is practically of no use and it has never been used on a larger scale in practice.

BRIEF SUMMARY OF THE INVENTION

It is an object of this invention to provide a method and device allowing to distinguish with high selectivity between potatoes and clods of soil and consequently to separate such pieces reliably. According to this invention further distinguishing criteria are obtained from the influence of said pieces onto a magnetic field. This solution is based onto the surprising fact that the influence of clods of soil onto a magnetic field substantially differs from the influence of a potato onto a magnetic field, such that a clear distinguishing criterion for recognizing and removing clods of soil may be detected. For detection of all necessary criteria a combined sensor is preferably used which is able to detect vibrations produced by the impact of the pieces onto the sensor and the changes of a magnetic field by the passage of a piece through this field. Such a sensor preferably has a membrane-like impact plate located within a magnetic field and an induction coil equally located in this magnetic field. Both the impact vibrations of the impact plate and the passage of clods of soil through the magnetic field penetrating the impact plate have an influence onto the magnetic field so that all required electrical signals are induced in the induction coil and may be analized for typical criteria in a suitable analyzing circuit. In this way it is possible to provide a relatively simple and cheap device for distinguishing and separating field crops, stones and clods of soil, this device being also highly reliable. The power rating is low and may be covered without any difficulty by any agricultural vehicle with which a separating or sorting device is coupled.

BRIEF DESCRIPTION OF THE DRAWING

The invention will now be explained in detail and by way of example with reference to the drawings wherein FIGS. 2 and 3 illustrate the construction and relative dispositions of a conveyor-tape and of the sensors, FIG. 4 is a section through a sensor.

DESCRIPTION OF THE PREFERRED EMBODIMENT

Figure 1:
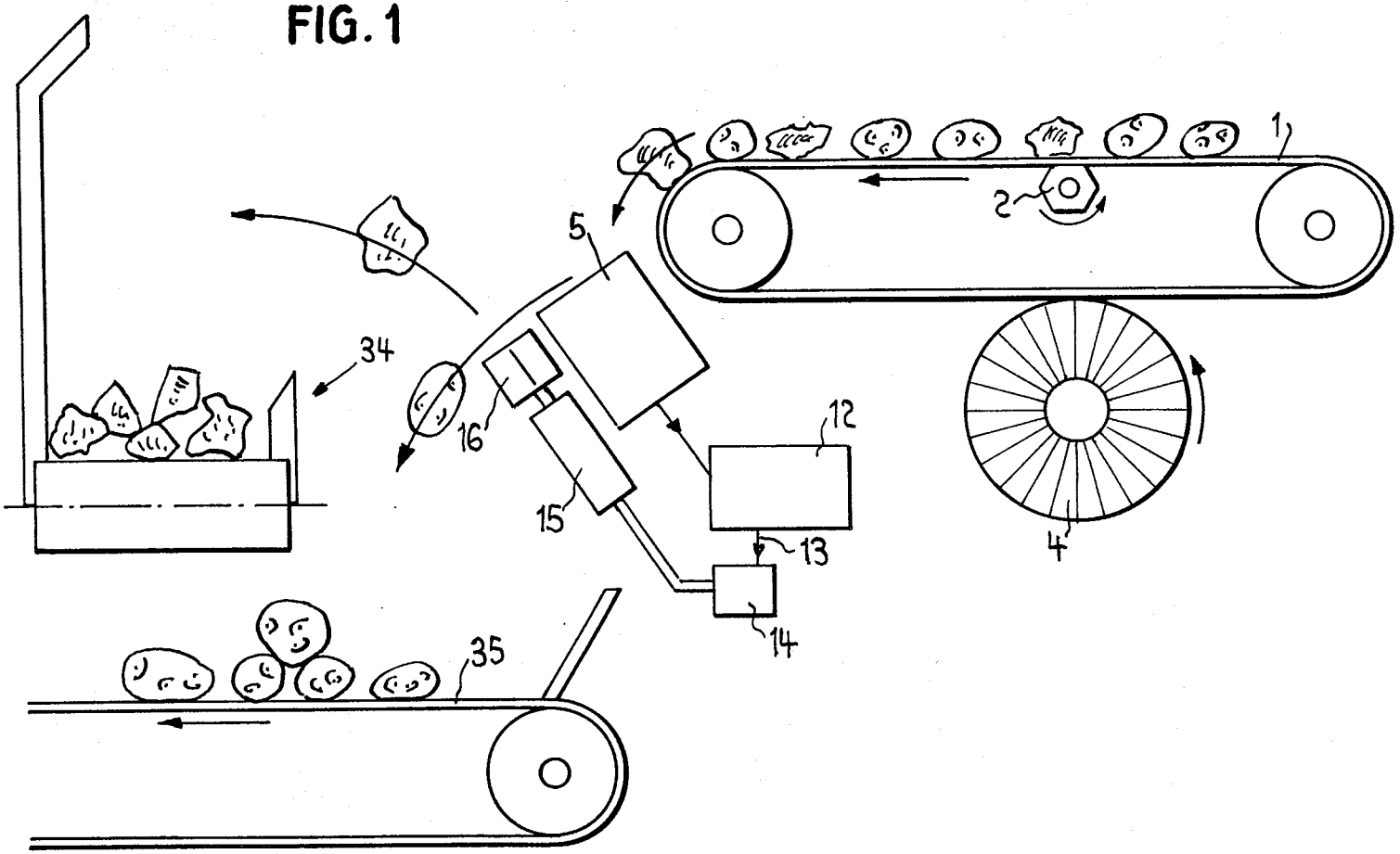
FIG. 1 is a schematic side view of a sorting device for potatoes, stones and clods of soil.

According to FIG. 1 the device has a conveyor belt 1 to which potatoes, stones and clods of soil are transported in a manner well known in the art and not shown in the drawing. A polygonal bar 2 is rotatably mounted below the upper side of the conveyor belt, this bar 2 rotating when the conveyor belt is driven for shaking the upper side of the belt and thereby properly separating and canalizing the pieces, namely potatoes, stones and clods of soil from each other. To this end the conveyor belt constructed of several separate belts has a suitable profile as shown in FIG. 2, each separate belt having a concave groove 3 having a width of 35 mm as an example. As shown in FIG. 2, smaller pieces are canalized substantially symmetrically in one of the grooves while bigger pieces may extend over two or more adjacent belts. The lower side of the conveyor belt 1 passes over a cleaning brush 4.

A row of detectors or sensors 5 is disposed in an inclined position below the exit end of the conveyor belt 1. As shown in FIG. 3, one sensor is provided below each groove 3 of the conveyor belt that is, an active sensor 5A is provided below each separate belt or groove 3 of the conveyor belt where pieces may fall off the conveyor belt. These sensors are accommodated in a common casing 6. A passive sensor 5B is disposed at each end of the row of active sonsors 5A, these sensors 5B being similar in construction to sensors 5A, but no pieces will fall onto sensors 5B. These passive sensors serve for compensation and elimination of noise signals produced in all sensors, as described later on.

FIG. 4 illustrates a section through one of the sensors 5A or 5B. Each of these sensors is mounted in a bore of casing 6 which may be made of aluminium, and each sensor has a pot magnet having a permanent magnet 7 and a soft-iron pot 8. An induction coil 9 is disposed in the ring space between the permanent magnet 7 and the pot 8, this ring space being compound-filled without any porosity. The upper face of the pot magnet 7, 8 is located at small distance from a damping plate 10 of a non-conducting material connected to an impact plate 11. The distance of the pot magnet 7, 8 from the impact plate 11 is less than 1 mm, and this impact plate 11 consists of a material allowing to the magnetic field from the pot magnet to penetrate through it, but having some influence onto the magnetic field. The plates 10 and 11 are disposed above the pot-magnet like a membrane, and vibrations will be set up in these plates when pieces such as potatoes, stones and clods of soil fall onto the impact plate 11. These vibrations are typical for each type of piece falling onto plate 11, and since this plate 11 has some influence onto the magnetic field, this field will undergo changes depending on the type of vibration, and thus electrical signals corresponding to the type of vibration will be induced in coil 9. By the passage of clean potatoes and stones the magnetic field is not directly affected, but clods of soil have a direct influence onto this magnetic field and induce typical signals in induction coil 9 as will be described later.

Figures 5, 6:
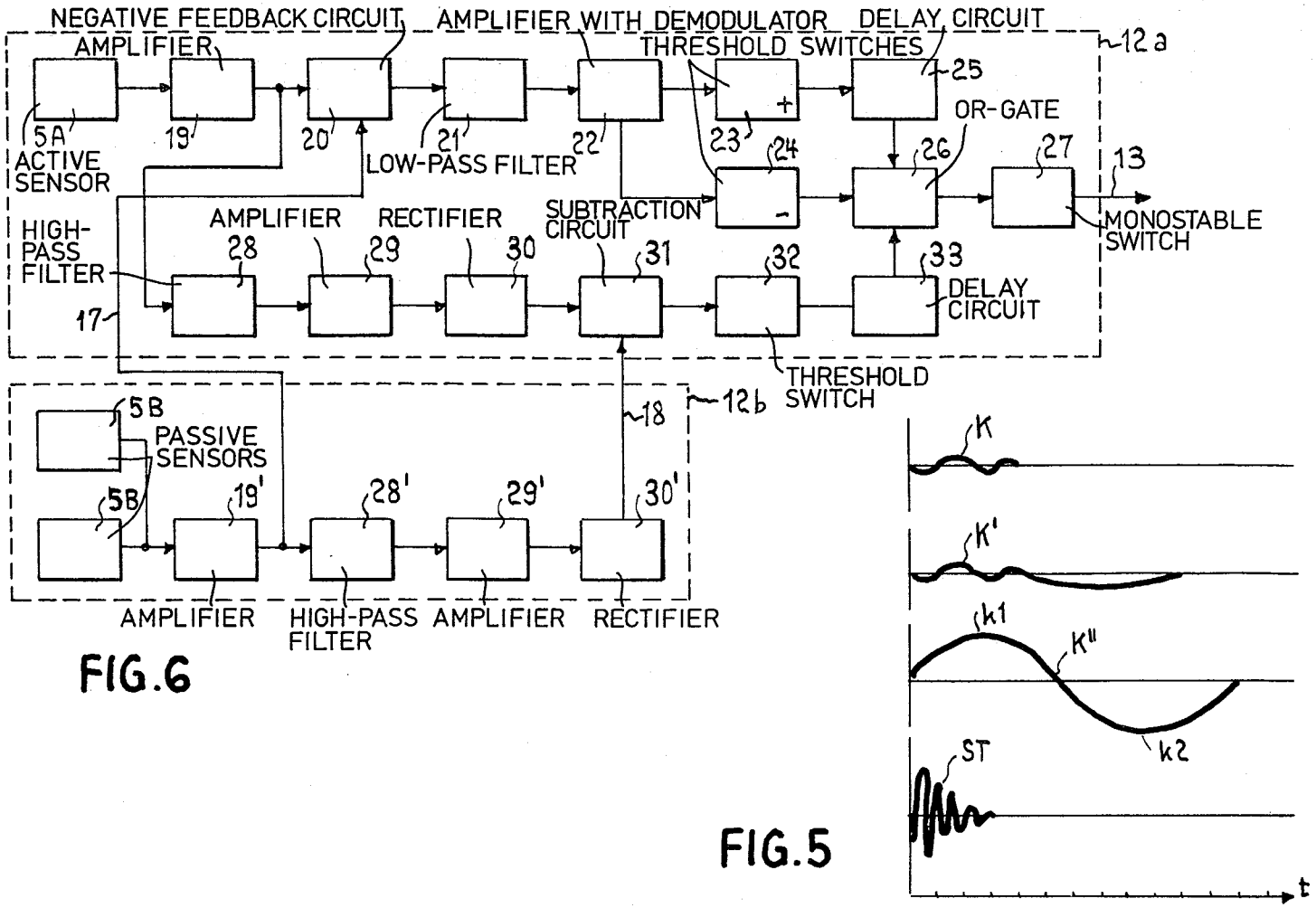
FIG. 5 shows typical signals induced in a sensor.
FIG. 6 is a diagram illustrating the detecting or distinguishing circuits.

FIG. 5 shows the various signals induced upon impact of a piece onto the impact plate 11. The impact of a clean potato produces a relatively weak vibration of low frequency of the impact plate 11, this resulting in a correspondingly weak signal K induced in coil 9. If the potato is substantially contaminated some influence of the soil adhering to the potato occurs, this resulting for instance in a weak positive pulse when the potato approches the sensor and a weak negative pulse when the potato leaves the sensor. This signal is designated by K' In FIG. 5. A clod of soil produces an alternating voltage of substantially greater amplitude K" with a positive half-wave k1 and a negative half-wave k2. Upon impact of the clod of soil onto the impact plate plate 11 a weak signal of relatively low frequency, somewhat similar to signal K produced by a clean potato, is superposed to this typical signal K". If a stone drops onto impact plate 11 a vibration and a corresponding electrical signal ST of substantially higher amplitude and frequency than upon impact of a potato or a clod of soil is induced.

FIG. 6 shows a diagram of a circuit for distinguishing and analyzing the signals as shown in FIG. 5. In FIG. 1 this circuit is generally designated by 12. Each active sensor 5A is connected to a circuit 12*a* having an output 13, this output 13 being connected to an electric valve 14 by which an ejecting cylinder 15 carrying an ejector 16 may be actuated. The circuit 12 further has a common circuit 12*b* having both passive sensors 5B connected in parallel to its input and of which the outputs 17 and 18 are connected to negative-feedback circuits or subtraction circuits of each circuit 12*a*.

Each active sensor 5A is connected via an amplifier 19 to a negative-feedback circuit 20, circuits 20 being also connected to the output 17 of circuit 12*b*. Circuits 20 are followed by a low-pass filter 21 and a further amplifier 22 including a demodulator. The output from the demodulator of amplifier 22 is connected to threshhold switches 23 and 24 of which the first one responds to positive voltage surges while the second one responds to negative voltage surges. Threshold switch 23 is connected via a delay circuit 25 to an OR-gate 26 while threshold switch 24 is directly connected to OR-gate 26. The output of OR-gate 26 controls a monostable switch 27. An other output of amplifier 19 is connected to the input of a high-pass filter 28 of which the output is connected to a rectifier or demodulator 30 via an amplifier 29. The output of rectifier 30 is connected to a negative feedback circuit of subtraction circuit 31. The output of circuit 31 is connected via a threshold switch 32 and a delay circuit 33 to a further input of OR-gate 26. The circuit 12*b* has circuits corresponding to circuits 28 to 30, namely a high-pass filter 28', an amplifier 29' and a rectifier 30'. Amplifier 19' of circuit 12*b* corresponds to amplifier 19 of circuit 12*a*. Therefore similar signals induced in sensors 5A and 5B are transmitted in exactly the same shape and amplitude to the inputs of the negative-feedback circuits 20 and 31 respectively so that such signals are compensated and eliminated in these circuits.

As explained above the output 13 of circuit 12*a* acts onto an electric valve 14 which controls an ejector cylinder 15 with an ejector 16. This ejector 16 is so disposed and its stroke is so selected that undesired pieces, namely stones and clods of soil are ejected by ejector 16 into a conveyor device 34 by which they are recycled onto the field. However, potatoes are not ejected and fall onto a conveyor belt 35 by which they are transported to their destination.

The operation of the illustrated device is as follows: if a potato falls onto the impact plate 11 of one of the sensors 5A, signal K is induced in coil 9, this signal having relatively low amplitude and frequency. This signal is amplified in amplifier 19 and is transmitted to the input of a channel comprising circuits 20 to 25 and to the input of a second channel comprising members 28 to 33. The signal is transmitted through circuits 20 to 22 but its amplitude is insufficient for releasing the threshold switches 23 and 24. This signal is not transmitted by high-pass filter 28 so that no signal is transmitted through channel 28 to 33 to OR-gate 26. Consequently no output pulse appears at output 13, valve 14 is not energized and the ejector 16 remains in its rest position and allows to the potato to fall onto the conveyor belt 35. The same operation occurs if a substantially contaminated potato falls onto a sensor. In spite of the slightly bigger amplitude of the signal K' as shown in FIG. 5 this signal is not able to release any of threshold switches 23 or 24 or to pass through the high-pass filter 28.

If a clod of soil falls onto a sensor 5 a signal of relatively high amplitude K" as shown in FIG. 5 is induced. This signal is of low frequency and is not transmitted by the high-pass filter 28. However, it is amplified in a low frequency channel including low-pass filter 21 and then releases threshold switch 23 with its positive half-wave. With some delay it releases threshold switch 24 with its negative half-wave. The delay in delay circuit 25 is so adjusted that both pulses are applied to OR-gate 26 simultaneously such that one single output pulse is applied to the monostable switch 27 and from the same to output 13. The electric valve 14 is energized whereby air under pressure is applied to cylinder 15 by which the ejector 16 is actuated and the clod of soil is ejected into the conveyor 34.

Experience has shown that often one of halfwaves k1 or k2 of signal K" is of insufficient amplitude for releasing the associated threshold switch 23 or 24 respectively. For this reason both halfwaves are transmitted separately and applied to OR-gate 26, practically simultaneously. In this way transmission of at least one releasing pulse effecting ejection of the clod of soil is assured.

If a stone falls onto one of the active sensors 5A a pulse ST of high frequency is applied to the inputs of low-pass filter 21 and of high-pass filter 28. This pulse is not transmitted by the low-pass filter 21, but it is transmitted by the high-pass-filter 28. It is then amplified and demodulated and it releases the threshold switch 32 from which a pulse is transmitted to OR-gate 26 through delay circuit 33. This pulse releases the monostable circuit 27 whereby an ejecting pulse is transmitted through output 13 to the valve 14. The ejector 16 is actuated with a delay accurately determined by the delay circuit 34 and it ejects the stone into conveyor 34.

The induced useful signals, particularly signals K and K', are extremely weak. Therefore it is probable that noise influences, for instance vibrations on portable or car-type equipment, electrical and/or magnetic fields of high-voltage transmission lines and so on would induce signals of sufficient amplitude for releasing the ejector. In order to eliminate noise signals of this type both passive sensors or comparating sensors 5B are accommodated in casing 6 under condition as similar as possible as those for sensors 5A. Under these conditions similar noise signals will be induced in all sensors and such signals induced in sensors 5B connected in parallel are amplified and transmitted to the negative-feedback circuits 20 and 31 with the same amplification and shape as corresponding noise signals induced in sensors 5A. In this way such noise signals are compensated and do not impair reliable operation in spite of the extremely high sensitivity of the analyzing circuits.

For similar reasons the induction coils 9 must rigidly be imbedded in a compound material, because any displacement of the coil relatively to parts of the pot-magnet or even relative movements between windings of the coil may produce noise signals which might effect an undesired release of the ejector.

The extremely low sensitivity of the sensors for vibrations which require a correspondingly high amplification or sensitivity of the analyzing circuits is necessary because the signals produced by impacts of potatoes and clods of soil should be smaller than the extremely weak signals K" resulting from the magnetic influence of clods of soil. This extremely low sensitivity of the sensors as a microphone is obtained by the use of an impact plate 11 having a very small influence onto the magnetic field intersecting the same. This may be achieved for instance by the use of a nonconducting plate having a thin casting of metal or by the use of a material having fine metallic inclusions. A non-ferromagnetic metal is preferably used so that the magnetic field may freely penetrate the impact plate and thus clods of soil may have an optimum influence on this magnetic field.

A device as explained above and illustrated in the drawing is now operating at full satisfaction under the following conditions: The speed of the conveyor belt 1 is 0.52 m/sec. At its exit-end where the pieces fall off the conveyor belt the same is returned by a roller having a diameter of 50 mm, whereby the conveyor belt has a thickness of 6 mm. The impact plate 11 has an inclination of 36.5° relatively to a horizontal plane, and the point of intersection of the axes of each sensor 5 through the outer surface of the impact plate 11 is at a horizontal distance of 62 mm and at a vertical distance of 30 mm from the axis of the return roller at the exit-end of the conveyor belt. The distance between the axes of adjacent sensors 5 and the associated ejector 16 is 37 mm measured in a direction parallel to the impact plate 11.

The impact plate 11 consists of a plate of plastic material reinforced by glass fibers and having a thickness of 1.4 mm. This plate has a copper coating of 10 μm thickness at its inner surface. This plate is available under the tradename "CEVOLIT" and usually serves for the manufacture of printed circuit plates. The impact plate 11 is glued to the upper surface of casing 6 by means of a self-adhering textile foil 10 having a thickness of 0.3 mm, and it is additionally screwed to the casing 6 in its four corners. The distance of the copper coating from the outer face of the pot-magnet 7,8 is 0.8 mm, and the diameter of the bore of the casing receiving a sensor is 34.5 mm. Under these conditions the impact of stones produces vibrations at frequencies well above 1000 Hz, while the impacts of potatoes and clods of soil produce vibrations at frequencies well below 1000 Hz. The high-pass filters and low-pass filters 28 and 21 respectively are adjusted accordingly.

The threshold switches 23 and 32 are adjusted for producing an output pulse upon occurrence of the lagging pulse edge that is when the threshold switch returns to its inoperative state when the signal induced by a clod of soil or a stone is decreasing. The output pulse from threshold switch 23 is delayed by 22 ms in circuit 25. On the other hand the threshold switch 24 transmits an output pulse at the leading edge of the control signal, this pulse being applied to gate 26 substantially at the same time as the delayed output pulse from threshold switch 23. The delay in circuit 34 is in the order of 33 ms. This control by output pulses produced during the lagging edges of the initiating signals has the effect that bigger pieces inducing stronger pulses are ejected with a somewhat larger delay than smaller pieces, this being desireable because the center of gravity of larger pieces will arrive somewhat later in the axis of the ejector 16. The interval between the beginning of the control pulse at the output 13 and the arrival of the ejector 16 at the end of its stroke should be in the order of 40 to 50 ms.

This device operates reliably for pieces having a size in the order of 20 to 100 mm. Smaller pieces are preferably sorted out by mechanical means before reaching the conveyor belt 1, and bigger pieces may be sorted out manually if necessary.

What we claim is:

1. An apparatus for separating field crops, particularly potatoes, from stones and clods of soil comprising:

(a) at least one sensor having a membrane and an electromagnetic transducer having a magnetic field that penetrates through said membrane;

(b) means for feeding and dropping field crops, stones and clods one-by-one onto said sensor membrane and through the magnetic field outside said membrane;

(c) said magnetic field being influenced both by vibration of the membrane due to impact thereof by field crops, stones and clods and passage through said magnetic field, the influence on said magnetic field in turn producing an output signal by said transducer, said output signal corresponding to the impact and magnetic field influencing property of each crop, stone, or clod;

(d) means for distinguishing a high frequency transducer signal induced by stone impacts and a lower frequency transducer signal induced by clod magnetic influence and for generating a separating signal upon detection of a stone or clod; and (e) separating means for separating stones and clods from crops, said separating means being actuated by said separating signal.

2. The apparatus according to claim 1, wherein:

(a) the means for individually feeding and dropping objects is a conveyor belt having an exit end, and a concave transverse profile for transporting and directing objects to defined drop zones at said exit end; and (b) a row of sensors are attached to the apparatus below the exit end so that one sensor corresponds to each drop zone.

3. The apparatus according to claim 1, wherein the transducer comprises (a) a pot magnet having surfaces defining a ring space;

(b) an induction coil positioned in said ring space; and (c) filler compound occupying all voids between said induction coil and said surfaces defining said ring space.

4. The apparatus according to claims 1, wherein:

(a) at least one of said sensors is a detecting sensor for impact by objects;

(b) at least one of said sensors is a reference sensor that is not impacted by objects;

(c) a measuring channel connected to each detecting sensor; and (d) a compensating circuit connected to said sensors and said measuring circuit for elimination of similar signals from said detecting and reference sensors.

5. The apparatus according to claim 1, wherein said means for distinguishing signals of said sensor include a first channel having a low-pass filter, a first threshold switch responding to positive voltage surges and a second threshold switch responding to negative voltage surges, both of said first and second threshold switches connected to said low-pass filter, a delay circuit connected to one of said first or second threshold switches and a coincidence circuit cooperating with said first and second threshold switches.

6. The apparatus according to claim 5, wherein said means for distinguishing signals further includes a second channel having a high-pass filter, a demodulator connected to said high-pass filter and a third threshold switch connected to said demodulator.

7. The apparatus according to claim 6, wherein both channels are connected to an OR-circuit, said OR-circuit connected to an ejector for ejecting stones and clods of soil such that an output pulse generated by said OR-circuit ejects a stone or clod of soil.

* * * * *